United States Patent [19]

Spriggs

[11] 4,434,581

[45] Mar. 6, 1984

[54] APPARATUS ADAPTED FOR AUTOMATIC OR SEMI-AUTOMATIC FABRICATION OF ULTRA-PRECISION OPHTHALMIC LENSES, E.G., CONTACT LENSES

[75] Inventor: Robert G. Spriggs, St. Petersburg, Fla.

[73] Assignee: Automated Optic, Inc., N. Saint Petersburg, Fla.

[21] Appl. No.: 377,105

[22] Filed: May 11, 1982

Related U.S. Application Data

[63] Continuation of Ser. No. 180,323, Aug. 22, 1980, abandoned, which is a continuation of Ser. No. 928,973, Jul. 28, 1978, abandoned, which is a continuation-in-part of Ser. No. 821,162, Aug. 2, 1977, abandoned.

[51] Int. Cl.[3] ..... B24B 5/00

[52] U.S. Cl. ..... 51/67; 51/284 R; 82/11

[58] Field of Search ..... 82/11, 18, 12; 51/58, 51/277, 284, 124 L, 67; 33/1 M

[56] References Cited

U.S. PATENT DOCUMENTS

| | | | |
|---|---|---|---|
| 2,582,087 | 1/1952 | Turner | 51/277 |
| 3,169,350 | 2/1965 | Corman | 51/58 X |
| 3,599,377 | 8/1971 | Dartnell | 51/277 |
| 3,605,345 | 9/1971 | Humphrey | 51/67 |
| 3,821,867 | 7/1974 | Hunkeler | 51/277 |
| 3,835,588 | 9/1974 | Whitham | 51/58 |
| 3,840,993 | 10/1974 | Shelton | 33/1 M |
| 3,903,656 | 9/1975 | Binder | 51/277 |
| 3,913,274 | 10/1975 | Raiford | 51/284 |
| 4,083,272 | 4/1978 | Miller | 51/58 |

*Primary Examiner*—Harold D. Whitehead

*Attorney, Agent, or Firm*—James A. Labarre; George M. Yahwak

[57] ABSTRACT

A method for forming a plurality of optical surfaces on an optical lens precursor, desirably a "soft" contact lens button or blank, to yield a lens adapted for proximate or intimate contact with an eyeball and defined by at least one posterior surface, an edge and at least one anterior surface, is comprised of forming a precision lens precursor, assembling the precursor in a microsurface generating apparatus, ultra-precisely forming the curves or geometry comprising the posterior surface and a portion of the edge to yield a semi-finished lens, blocking the semi-finished lens on an adhesively coated lens block fixture having an ultra-precisely preformed face for intimate precision mating with the posterior surface of the semi-finished lens, reassembling the semi-finished lens/fixture in the microsurface generating apparatus, ultra-precisely forming the curves or geometry comprising the anterior surface and another portion of the edge, and demounting a finished, ultra-precision lens from the blocking fixture. Also disclosed is a fluid-bearing automatic or semi-automatic machine for performing the instant method to ultra-precision, e.g., by computer control.

16 Claims, 7 Drawing Figures

APPARATUS ADAPTED FOR AUTOMATIC OR SEMI-AUTOMATIC FABRICATION OF ULTRA-PRECISION OPHTHALMIC LENSES, E.G., CONTACT LENSES

This application is a continuation of application Ser. No. 180,323, filed Aug. 22, 1980 now abandoned, which is a continuation of Ser. No. 928,973, filed July 28, 1978 now abandoned, which in turn is a continuation-in-part of Ser. No. 821,162, filed Aug. 2, 1977 and now abandoned.

BACKGROUND OF THE INVENTION

1. Field of the Invention:

The present invention relates, broadly, to a low microinch surface generator adapted, particularly, for the manufacture of plastic contact lenses. Most specifically, the present invention relates to apparatus for the fabrication of soft or hydrophilic contact lenses by precision machining a lens precursor (e.g., button, blank or even bonnet) in the non-hydrated state.

2. Description of the Prior Art:

Numerous methods and apparatus are well known for the fabrication of optical surfaces on a variety of optically-efficient materials. Among these materials might be included various grades of glasses and plastics as well as, for reflective optical applications, metals. However, quantitatively, the manufacture of vision-corrective optical articles far outweighs the remaining areas of endeavor in this field. Surprisingly, therefore, it is found that few truly efficient methods and apparatus exist for the manufacture of vision-corrective optical articles; most approaches being rather pragmaticion an individual basis and possessed of anachronistic shortcomings.

Perhaps the routine use of obsolescent technology is most encountered in the manufacture of contact lenses for the correction of vision defects, and including the manufacture of the new, soft or hydrophilic polymeric contact lenses. With the modern shift from eyeglasses to contact lenses, the first generation hard synthetic plastic or glass-type contact lenses were initially fabricated based upon mere industrially-acceptable and conventional techniques. Thus, the hard plastic [typically polymethylmethacrylate or "MMA"] or glass lens precursors were formed in a rough state, ground, and subsequently polished either manually, or semimanually with the aid of conventionally employed optical polishing machines. Again, with the conversion from hard contact lenses to soft, hydrophilic lenses, antiquated methods and apparatus were perpetuated,notwithstanding the highly significant differing physical and chemical characteristics between these hydrophilic polymers and the materials for which the prior methods and apparatus were initially designated.

One deviation in the manufacture of soft contact lenses emerged in the form of the spin casting of the hydrophilic monomer during the very polymerization process therefor. While clearly a departure from conventional optical machining and polishing, the spin casting technique was found to be but a basically acceptable compromise, required primarily by the very nature of the lens material. Thus, the compromise is regarded as successful only inasmuch as the ease of process control has been fostered, but at the sufferance of optical quality and reproducibility. This is due to the fact that the anterior surface of the finished lens is predicated upon the shape and quality of the mold cavity, while that of the posterior surface is dictated by the centrifugal forces established during the spin casting process as the monomer polymerizes, viscosity, and the like. Because it is recognized that the surface of the eyeball is not uniform, but has a substantially varying rate of curvature generally corresponding to the apical portion of prolate ellipsoids, paraboloids, and hyperboloids, the ability to properly fit a centrifically cast hydrophilic contact lens with the optimum visual acuity is minimized. Moreover, even a centrifugally cast lens must be manually or otherwise edged. Accordingly, this technique has been found to be less than adequate in meeting the needs of the industry in properly balancing the ease of reproducibility and repeatability with the requirements of enhanced optical fit and power and, thus, wearer comfort and optical efficiency of the finished lens, particularly for those with astigmatic defects.

The art has recognized the advisability of producing methods and apparatus for machining or grinding the hydrophilic lens material in a non-swollen or dehydrated physical state. However, these approaches have not yielded a substantially improved finished lens for a number of reasons. Most significantly, the improvements in methods and apparatus heretofore proposed have merely centered about the modification of old technology, rather than an attempt to provide a totally new and improved system or concept which specifically accounts for the physical and chemical vagaries of the hydrophilic materials to be formed. Thus, it is routinely found that, for example, the tolerance limits of the machines employed far exceed those desirable tolerances for the finished product. Consequently, constant operator scrutiny and subsequent, costly rectifying procedures must be employed to yield a precision lens, or to otherwise salvage defective articles.

Furthermore, the very nature of the materials employed in the fabrication of these soft lenses mandates a critical appraisal of current production techniques. For example, in addition to all of the exacting operating procedures necessarily employed in the manufacture of high quality optical articles, the machining of hydrophilic polymers in a non-swollen or anhydrous condition entails process control far beyond that necessary for the analogous machining of glass or hard plastic lenses. For example, the hydration factor must be taken into account since the ultimate shape of the lens in the hydrated state may differ by 15%, or more, from that in the dehydrated stage. This further complicates the handling of the lenses during the fabrication steps since even a small amount of moisture, such as that on the tip of an operator's finger, or ambient humidity, can materially, locally swell the lens procursor. Consequently, should the operator touch the lens during the manufacture thereof, perspiration will cause local swelling which ultimately be machined or polished away during further process steps. When the lens then dehydrates at the local position, an obvious, and oftentimes fatal, flaw results, thus rendering the lens unsuitable for its intended purpose.

Yet other problems are encountered due to the nature of the physical and chemical characteristics and properties of soft contact lenses. For example, soft contact lenses not uncommonly have a greater diameter than the had lens counterparts. Also not uncommonly, a soft lens extends well into the scleral area of the eyeball, thus transgressing the sensitive limbus.

Moreover, due to the changing rate of curvature ofnot only the cornea but the scleral area, the optimum lens configuration will account for these differences and thus, be provided with a posterior surface which matches this changing rate of curvature of the cornea, jumps the limbus, and rests again on the sclera. And, while the scleral area is less sensitive than the cornea or limbus region, it is also essential that the edge radius of the lens be smooth and contoured to minimize eye irritation during wear. Also, while the posterior surface must account for the aspherical aberrations of the eyeball, the anterior surface must likewise be machined to very exacting tolerances, regardless of whether or not a plus or minus lens is to be yielded, to provide the required optical chaacteristics for the lens. To adequately account for the demanding designs inherent in quality optical contact lenses, it is thus essential to provide a maximum acceptable gross tolerance on the order of 0.001 inches, while optical surfaces should exhibit a finish of at least 4 microinches. Obviously, the greater the number of operating steps or points of human operator intervention, the less realistic become the attainment of these objectives.

Various automated processes, and apparatus therefor, have been proposed in the prior art. For example, U.S. Pat. No. 3,913,274 discloses a method and apparaus for making integrated multifocal lenses wherein a lens precursor is rotated in a lathe chuck and appropriately indexed in contact with a cutting tool or grinding wheel. The disclosed invention is predicated upon an adaptation of a conventional lathe whereby the lens is secured in a rotating spindle which also provides relative motion in two orthogonal directions in a plane perpendicular to the center of rotation of the lathe. The tool bit or grinding wheel is also caused to rotate about a variably controlled pivot point to allow for the cuttingor grinding of different curvature radii of the multifocal lens. Appropriate translation of the cutting tool and rotating lens is achieved by means of a digital computer.

While such apparatus are efficient for the manufacture of relatively large lenses, their utility is diminished when the workpiece is reduced to the much smaller size of a contact lens. For example, the column which supports the lens precursor, and which is tilted relative to the rotational axis of the lathe spindle, is not suitable for use as a fixture for supporting and rotating the much smaller contact lens. Moreover, the need to provide substantial superstructure in order to achieve sufficient relative freedom of motion tends to decrease dimensional stability by increasing the number of sources which contribute to dimensional error. Also, it is obvious that significant operator intervention is needed in order to practice the disclosed process, further contributing to potential sources of dimensional instability and lack of reproducibility from lens to lens.

Another apparatus is disclosed in U.S. Pat. No. 3,835,588, relating to a lenticular contact lens lathe. Again, because the apparatus is patterned on a standard contact lens lathe, which has been modified to provide for an orthogonal translation system via cascaded movable carriages, inherent dimensional instability is built within the system. Moreover, it is necessary to cast or otherwise preform the lens precursor with the posterior surface thereof. Consequently, the same disadvantages obtaining with the spin casting of hydrophilic monomers is indigenous to that disclosed process.

Similar apparatus and processes are disclosed in the U.S. Pat. Nos. 3,064,531 and 3,100,955, wherein the lens precursor must first be subjected to a substantial preforming operation in order to render the same compatible with a lathe chuck or other conventional securing member. In the case of the former patent, the lens precursor is threaded for insertion within a special chuck having a matting thread. In the case of the latter, the precursor is first formed with a peripheral ear for restraint within a sleeve. Obviously, the preforming steps are highly undesirable.

In an effort to minimize operator intervention by maximizing the number of process steps on a lens blank between mounting and demounting thereof, a quite mechanically exotic apparatus is disclosed in U.S. Pat. No. 3,686,796. The machine therein described performs multiple operations, including machining, lapping, edging, and/or polishing a lens which is retained in a rotatable lens holder relatively indexable with respect to a plurality of pivotally mounted spindle heads, each for performing a given opeation. Obviously, the complexity of such a machine and the need to provide the great number of separate machine tools which must be accurately registered fromn step-to-step are highly undesirable from a commercial point of view.

Conventional pantographs and cam followers have been adapted for fabricating contact lenses, but not without suffering many of the problems noted above and without providing the ability to produce high quality articles in reproducible, commercially-acceptable quantities. These deficiencies may be attributed to, for example, the complexity of mechanical linkage, inherent machine and ambient vibrations, the inability to produce an article of better quality than that of the pattern's surface, etc.

Yet a further problem evident with prior art methods and apparatus for forming contact lenses is the inability of the same to yield an edge, as machined, without defects. Consequently, various postforming polishing operations such as those disclosed in U.S. Pat. Nos. 3,032,936 and 3,736,115, are necessary. Again, by increasing the number of operations, potential additional sources of error are encountered.

Accordingly, the need exists to provide a scientifically sound concept, method and apparatus for the reproducible, simple, and efficient manufacture of high quality optical surfaces on an optical lense precursor, whereby the number of process steps are minimized and which substantially diminishes the need for human intervention.

SUMMARY OF THE INVENTION

In accordance with the noted and notable deficiencies of prior art methods and apparatus for forming optical surfaces on a lens precursor, it is a primary object of the present invention to provide an automated or semi-automated machine which materially increases productivity, reproducibility and efficiency while concomitantly reducing the cost of manufacture of the resulting lense.

Yet another object of the present invention is to provide an automated or semi-automated machine which incorporates a fluid-bearing microinch surface generator for fabricating spectacle lenses and contact lenses, particularly contact lenses.

Still a further object of the present invention is to provide an automated or semi-automated apparatus comprising fluid-bearing X-Y positioning tables, in concert with a fluid-bearing work supporting spindle, for the simple, efficient, and economical manufacture of hydrophilic contact lenses, which are machined in their "hard" or non-hydrated state. Most preferably, such apparatus is computer controlled and electronically driven to produce a predetermined path of infinite resolution.

Still further objects of the present invention will become apparent to the skilled artisan upon examination of the detailed description of the invention, taken in conjunction with the Figures of Drawing.

In consonance with the aforenoted objects of the present invention, it has now been determined in accordance therewith that a plurality of optical surfaces may be formed on an optically-efficient material through use of an automated or semi-automated machine which is comprised of a fluid-bearing tool positioning table in concert with a rotatable, fluid-bearing work supporting spindle, said spindle itself being mounted upon a secondary fluid-bearing positioning table situated perpendicular to the tool positioning table. Tool positioning is appropriately indexed via computer control utilizing appropriate feedback system including, e.g., linear or rotary encoders or laser interferometric methods, whereby any complex lens geometry may be easily and reproducibly fabricated.

The automated or semi-automated method of the present invention comprises the steps of assembling a precision lens precursor to the work holding device of the spindle member, generating the appropriate lens geometry on a first face of the lens precursor, removing and blocking the semi-finished lens on a fixture therefor, indexing the semi-finished lens/fixture assembly to the spindle, generating the opposing lens surface geometry, and demounting a precision, optically finished lens from the blocking fixture.

BRIEF DESCRIPTION OF THE DRAWINGS

FIG. 6 is an enlarged view of a finished contact lens; and,

DETAILED DESCRIPTION OF THE INVENTION

In order to more fully elucidate upon the various objects and advantages of the present invention, the same will be described in terms of various preferred embodiments thereof. Further along these lines, the invention will be described in terms of the manufacture of a hydrophilic contact lens. However, it will be appreciated that the same are intended as illustrative, and in no wise limitative.

The present invention relates to the formation of optical and complementary surfaces on optically-efficient materials and, more particularly, to the fabrication of hydrophilic contact lenses. The present invention overcomes substantially all of the prior art deficiencies inherent in the use of antiquated methods and apparatus for the manufacture of, e.g., contact lenses and, more specifically, from hydrophilic polymeric materials. That is, the instant method and apparatus minimizes operator handling, while maximizing process efficiency, strict repeatability and product quality.

Currently, apart from the spin casting of hydrophilic contact lenses, small lathes with radius turning attachments, primarily under manual control, are employed as standard production apparatus. And, while the operators need not be skilled in the machinists' sense, they nonetheless require several weeks or months of training before becoming adept enough to generate lenses at a yield of more than, approximately, 25%. Moreover, whether it be attributed to operate skill and/or machine tolerance, accuracy and reproducibility are each quite low thus necessitating laborious hand polishing to obtain an acceptable finish. Also, the ability to cut curves having other than simple radii is minimized,if not precluded, inlight of the foregoing limitations. In sum, the present state-of-the-art of contact lens manufacture is more art than science.

Figure 1:
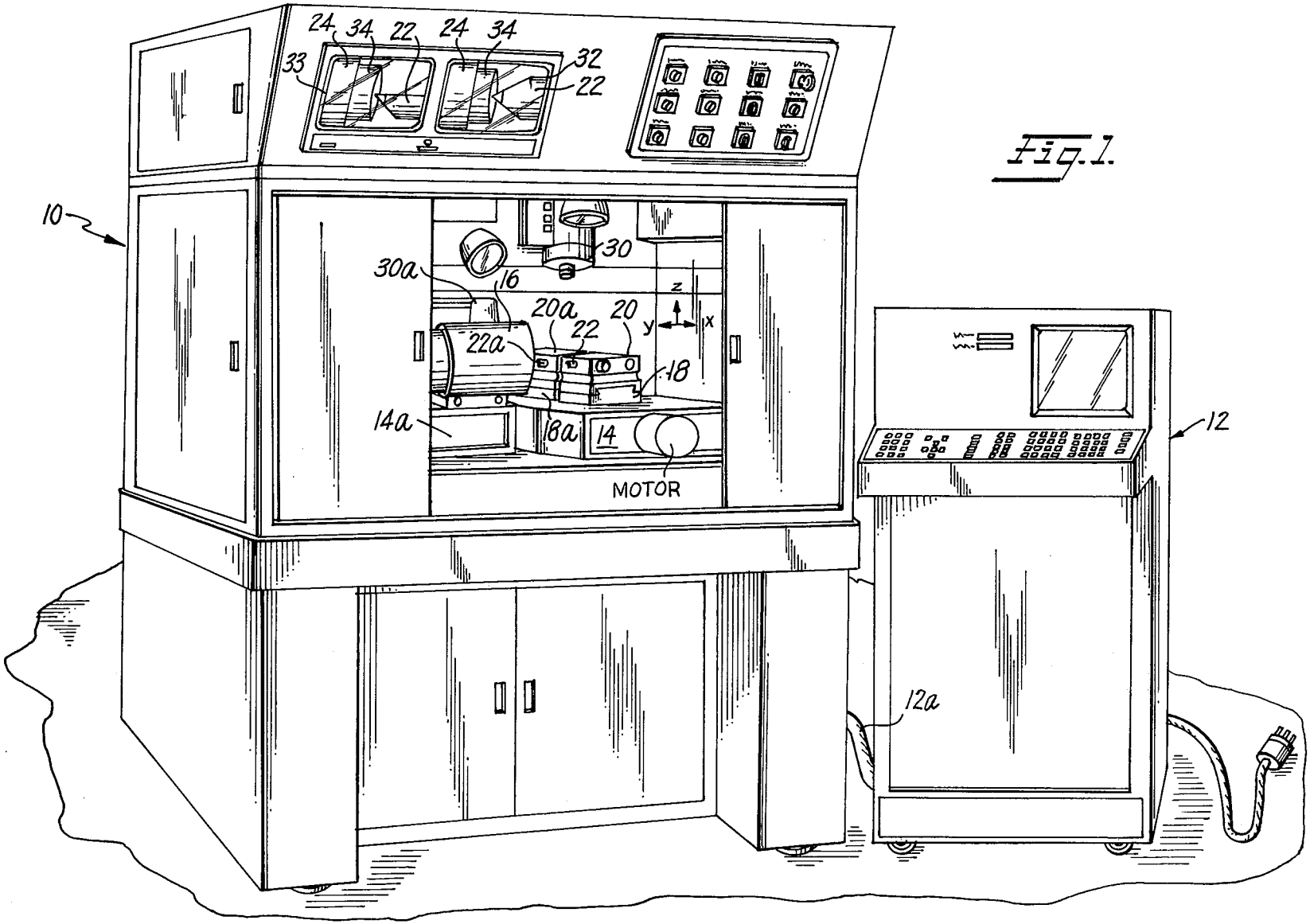
FIG. 1 is a perspective illustration of the microinch surface generating apparatus of the present invention, and its associated computor controller.

FIG. 1 illustrates, perspectively, a microinch surface generator, designated generally as 10, and an associated computer control therefor 12. Numeral 12*a* designates the electronic interface cable linking the computer 12 to the generator 10. Microinch surface generator 10 is comprised of a fluid-bearing tool support Y-axis table or slide 14 and a fluid-bearing work support spindle motor designated generally as 16. Spindle 16 is itself fixedly mounted upon a second fluid-bearing X-axis positioning table or slide 14*a* which is disposed perpendicular to the axis of movement of the tool positioning table 14. Preferably, these fluid-bearing components are gas-bearing structures; most preferably, air-bearing. The table drive (axially reciprocating) are preferably comprised of electronically driven, computer controlled D. C. torque motors, to avert the roughness arising from the use of conventional stepper motors, and which motors are coupled to zero backlash lead screws. The table 14 supports a tool holder base 18, fixedly secured thereto, upon which is borne a tool positioning block 20. The tool positioning block 20 is adapted for axial reciprocation (not shown) along the z axis, whether manually or otherwise, and advantageously is equipped with both radical and fine adjustments. A suitable cutting tool 22 is firmly attached within the block 20. The tool 22 is, most preferably, an ultra-precision, angularly set, cylindrical diamond-tipped cutting tool, although it might be an ultra-precision rotary tool such as, e.g., a grinding wheel or burring tool. Regardless of the type of cutting tool employed, it is essential, and especially so with respect to the preferred diamond-tipped cutting tool, that the same present a substantially absolutely circular cutting surface to the workpiece of, e.g., non-hydrated hydrophilic polymer. Thus, in the preferred embodiment, the diamond-tipped tool is provided with a circular cutting surface within a tolerance of 0.005 inches truth of circular profile, most preferably within 0.00005 inches truth of circular profile.

In a most preferred embodiment of the invention, the Y-axis table or slide 14 supports a plurality of base/-block/tool modules, for example, a base 18/block 20/roughing cut tool 22 module and a base 18*a*/block 20*a*/fine cut tool 22*a* module fixedly spaced apart along a common Y-axis parallel to that of the table 14, and adapted such that after the roughing cut tool 22 has been electronically indexed to the workpiece and done its work, and fine cut tool 22*a* can conveniently be electronically relocated in its place for the ultra-precision finishing.

Figure 2:
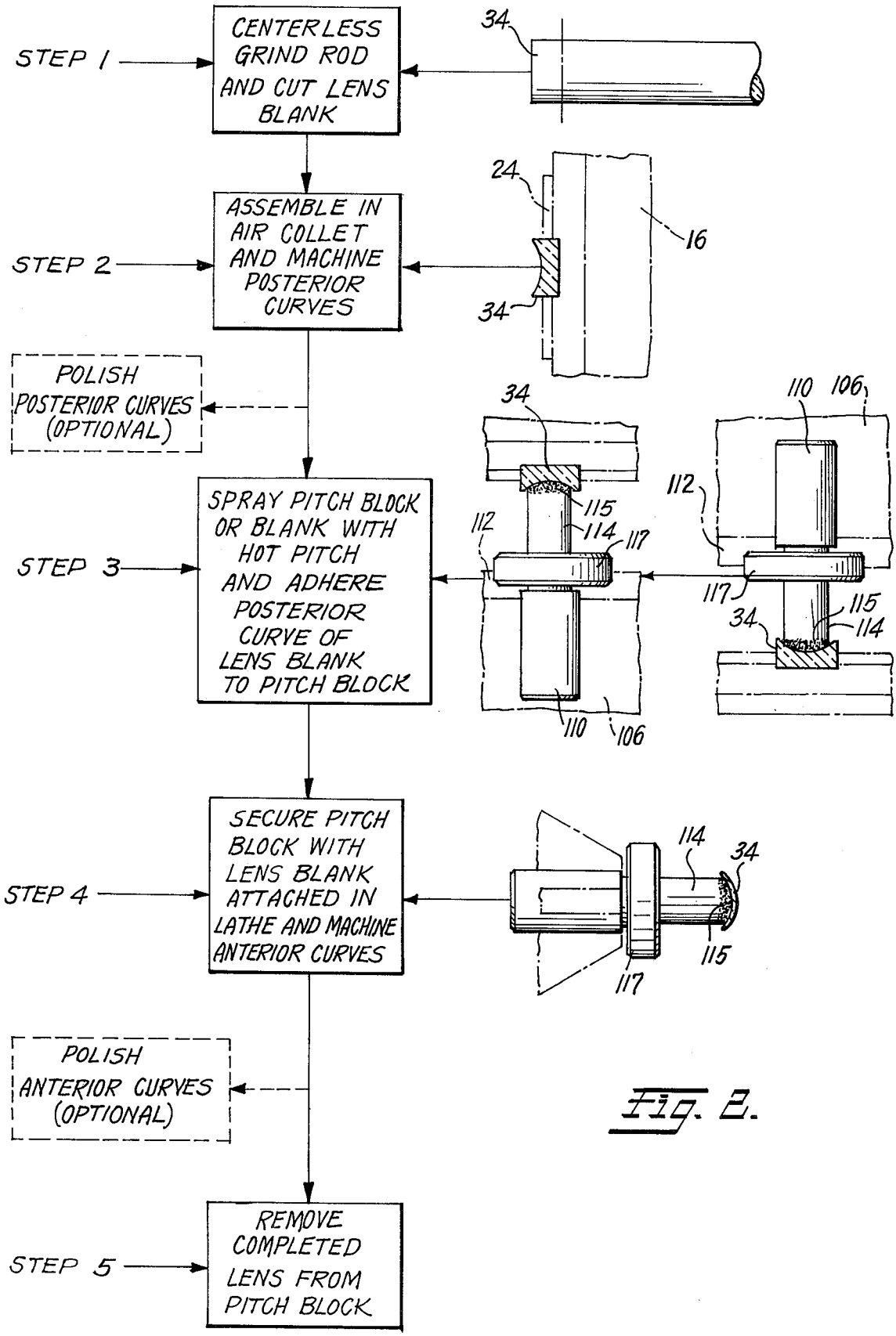
FIG. 2 is a flow diagram of the process of the present invention, and shows schematically the configuration of a lens as it is formed during this process.

The work supports spindle 16 terminates in a work holder, preferably an air collet 24, as viewed in FIG. 2. The spindle/motor is fluidly rotatable about a horizontal axis, as is known to the art.

By employing the fluid-bearing X-Y tables 14 and 14*a*, in concert with the computerized controller, any complex surface geometry may be generated, provided the mathematical function describing that geometry is unique in a given quadrant; i.e., any curve which has only one Y for each value of X. The tables are provided with substantial rigidity to avoid deflection under cutting loads, which is further aided by appropriate provisions for smoothness of operation and freedom from backlash. This is achieved, primarily, by employing a table bed of about 4,000 pounds, in a preferred embodiment by incorporating a granite bed isolated from vibration.

In a highly preferred embodiment, both the X and Y slides for tables 14 and 14*a* are air-bearing slides driven by fine pitch lead screws incorporating self-aligning nuts and D. C. servo motors. Position monitoring is achieved by electro-optical encoders with 0.5 micron resolution. A tachometer is in operative communication with the motors and the computer controller to enhance servo stability.

The spindle 16 is likewise based upon an air-bearing slide to optimize the optical surface finish, as well as to ensure both isolation from vibration and tool life. The spindle motor can be present at any suitable value over the range of from about 1,000 to about 30,000 rpm, and is comprised of an integral drive motor. Radial and axial runout of the spindle/motor are maintained at no greater than 0.000010 inches T.I.R.

In order to effect accurate pre-positioning between the tool 22 and the workpiece restrained within air collet 24, there are optionally provided a pair of closed circuit television cameras in two mutually orthogonal planes. A first optional camera, 30, in concert with a video display 32 allows the operator to view an enlarged picture of the tool 22 relative to a workpiece 34 in the horizontal plane. A second optional camera 30*a* is disposed 90° from camera 30, to the rear of the housing for microsurface generator 10, and operates in concert with optional video display 33 for allowing the operator to view an enlarged picture of the tool 22 relative to the workpiece 34 in a vertical plane. In a preferred optional embodiment, the cameras are Panasonic WV-NOOP CCTV cameras for continuous monitoring of both vertical and horizontal positioning. The video display units are Panasonic No. WV-952 monitors. For contact lens manufacture, the image is optically magnified about 30 times.

The X-Y, fluid-bearing tables 14 and 14*a* allow relative fluid movement of the tool 22 with respect to the spindle/motor 16 in two orthogonal directions, defining a horizontal X-Y plane. To facilitate tool set-up, the tool positioning block 20 in concert with base 18 provides Z translation of the tool 22 by appropriate operator manipulation. Similarly as regards block 20*a*, base 18*a* and tool 22*a*.

Figure 3:
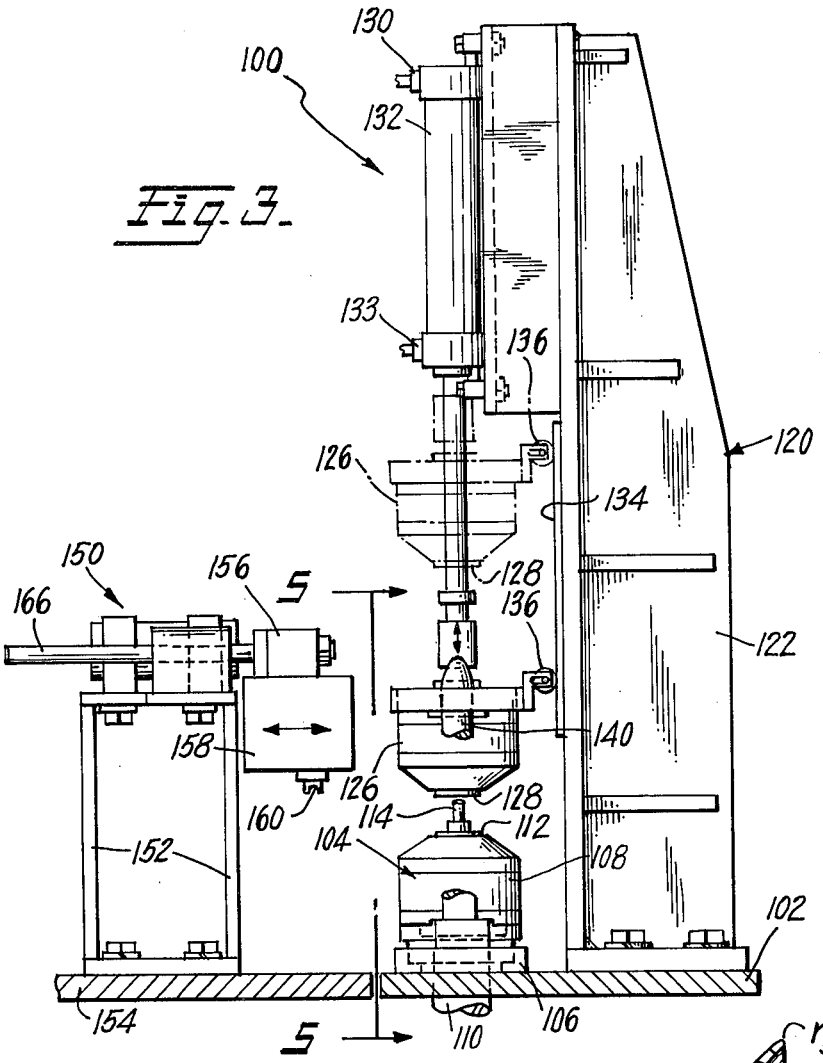
FIG. 3 is a side elevational view of the lens blocking apparatus of the present invention.
Figure 5:
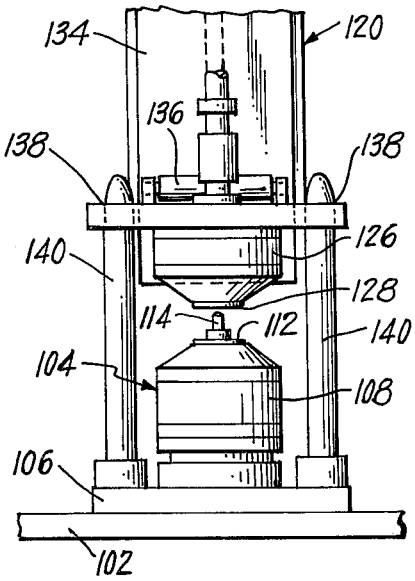
FIG. 5 is an exploded, side, fragmentary view taken substantially along the line 5–5 of FIG. 3.
Figure 8:
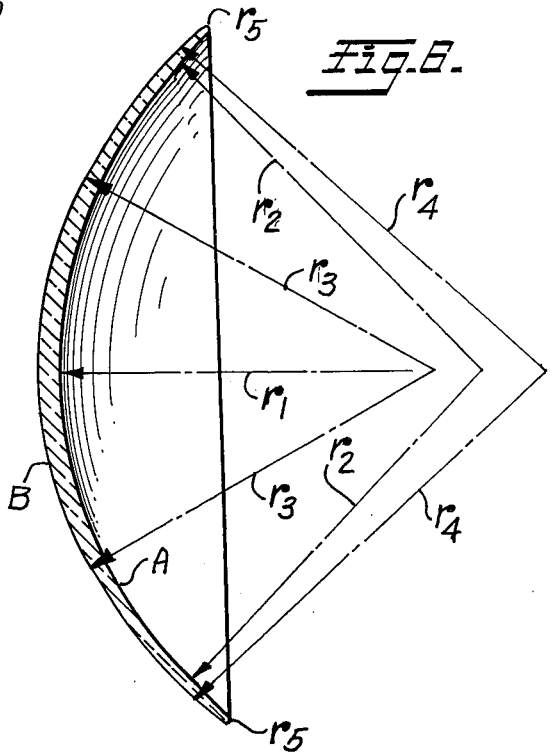
Figure 4:
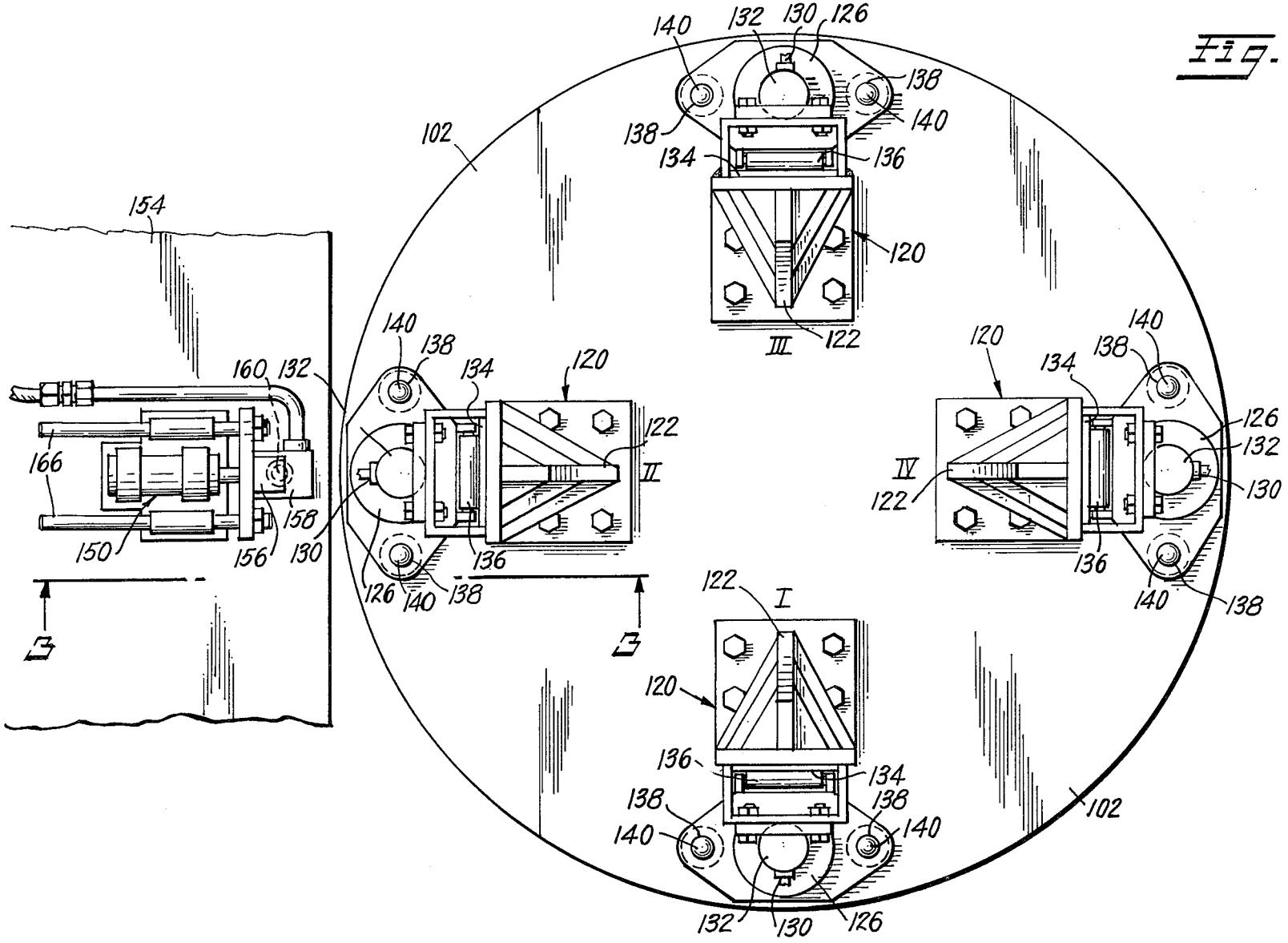
FIG. 4 is a top plan view of the lens blocking apparatus of the present invention.

FIGS. 3–5 illustrate a lens blocking machine, designated generally as 100, which is utilized in concert with the microsurface generator 10, and defines a necessary element of the overall system. The lens blocking machine 100 is comprised of a rotatable, generally circular table 102, although any of a number of geometries are conceivable. As best viewed in FIG. 4, a plurality of rotatable lower spindle assemblies 104 are located equidistantly around the periphery of the table 102, four such assemblies being shown spaced 90° apart. Each of the assemblies 104 is comprised of a stationary base 106 and a rotatable spindle 108. A shaft 110 is in operative communication with spindle 108 for imparting any desired rotational movement thereto. Spindle 108 terminates in an air collet 112 for grasping a preformed lens block 114.

The lens block 114, conventionally termed a "pitch-block" in the art, is preferably fabricated from tool steel which is heat treated to exhibit a hardness of about 60 Rockwell/C scale to insure good service life, dimensional stability and minimize damage to the surface area for supporting a lens. The lens blocks are precision ground and lapped to a surface geometry and tolerance better than that prescribed for the finished lens, preferably "better than" by a factor of at least 4–5 times. Thus, there is provided a reusable lens block having both a high service factor along with the ability to very accurately establish precision datum reference points for subsequent lens shaping. Moreover, the automated or semi-automated machine of the present invention is particularly designed for operation with a plurality of lens blocks which will undoubtedly be machined with varying radii of curvature regarding the lens-supporting surface to account for varying lens geometries. Thus, it is further essential that strict uniformity of the overall dimensions of the lens blocks be maintained regardless of differences in that supporting surface, in order to insure reproducibility in establishing a zero datum point for lens generation which insures maintenance of lens center thickness. To achieve this objective, the distance from the back banking surface 117 of the lens block, which locates the lens block in the holder (e.g., collet), to the apex of the radius of the lens-supporting surface must be maintained uniform for all of the lens blocks utilized within a tolerance limit of ±0.001 inches, preferably ±0.0005 inches, most preferably ±0.0001 inches.

Disposed adjacent, and projecting vertically above, the assembly 104 is an upper work supporting spindle assembly designated generally as 120. Accordingly, each of the four positions illustrated may be viewed as having the appearance of a small bench press. The assembly 120 is comprised of a vertical support member 122 to which is appended an air actuated carriage 124 for vertical translation of a work supporting spindle 126. The spindle 126 terminates in an air collet 28 for receiving a semi-finished lens which is to be accurately positioned and secured to the lens block 114. Collet 126 may be displaced from an upper load configuration as shown in phantom lines in FIG. 3 to a lower assembling configuration by means of the introduction of, for example, compressed gas at metered inlet 130 of gas piston 132. Retraction may be effected by providing reverse bias on the piston and allowing the gas to escape through a metered exit port 133, or by the application of positive pressure through port 133.

Accurate positioning between the collets 104 and 126 is achieved by causing the latter to translate vertically downwardly along a guide plate 134 borne upon support structure 122, the guide plate cooperating with a roller assembly 136. As best viewed in FIG. 5, the upper spindle 126 is further provided with a positioning plate 136 having a pair of apertures 138, which apertures are fitted with bushing members. Cooperating therewith are a pair of opposing guide pins 140 borne upon support plate 106, in association with the lower spindle assembly 104. Thus, as upper spindle 126 is caused to be downwardly displaced by actuation of air piston 132, the guide pins 140 will accurately position the same relative to the lower rotatable spindle 108.

Located proximate the spindle assembly 104 is an adhesive dispenser, designated generally as 150. Any of a number of suitable adhesives may be employed for affixing a lens to the lens block 114, the selection of an appropriate composition being well within the purview of the art. Dispenser 150 is supported by members 152 secured to a base member 154 at a height whereby a reciprocable dispensing assembly 156 may be indexed to a positioning immediately above lower spindle assembly 104. Dispenser assembly 156 is comprised of a reservoir 158 for heating and containing the adhesive to be dispensed where heating is appropriate, and a dispensing orifice 160. Horizontal translation of the assembly is achieved by movement of a shaft 162 which is controlled, preferably, by an air actuated mechanism (not shown). The shaft 162 terminates in a head member 164, to which are fastened a pair of shafts 166 for guiding the reciprocable assembly 156 during the indexing thereof. Dispensing of adhesive under compression is effected by controlled admission through a fitting 170 and a conduit 172 in communication with suitable reservoir (not shown) into the dispensing head 158, and ultimately through dispensing orifice 160.

Alternatively, as is also generally shown in FIG. 2, the lens blocking machine may comprise a single spindle assembly.

Figure 7:
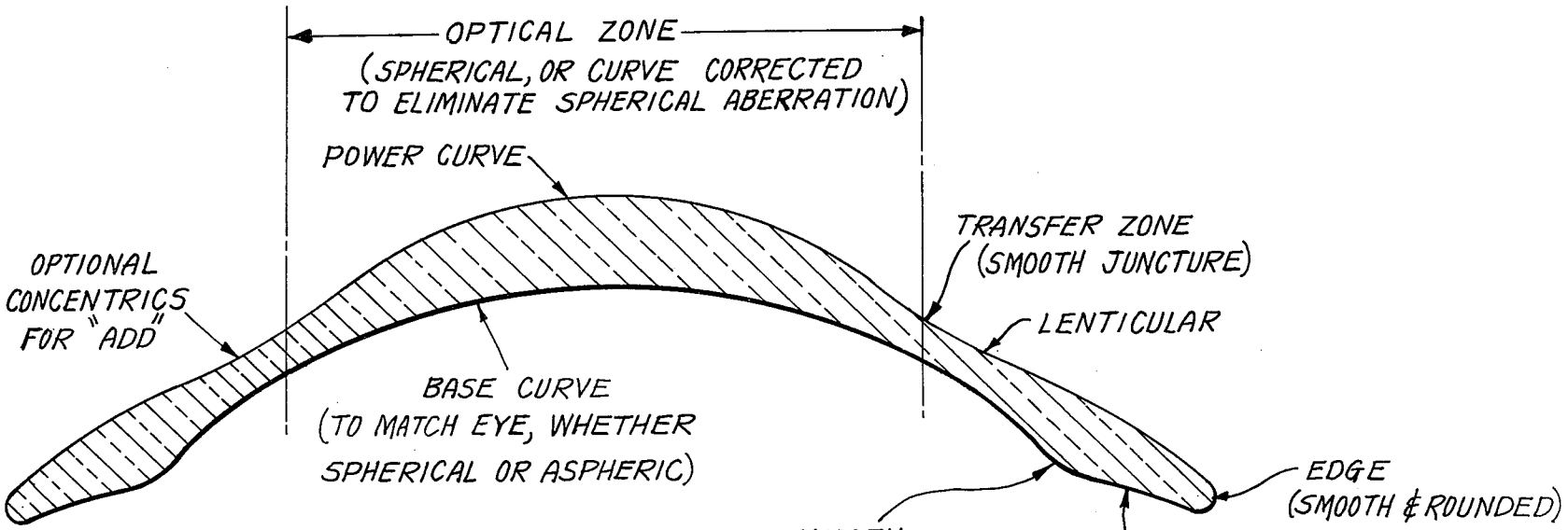
FIG. 7 is an even more enlarged view of yet another finished contact lens formed according to the invention.

FIG. 6 illustrates, in cross-section, a finished contact lens of greatly exaggerated dimensions in order to exemplify the plurality of optical surfaces comprising the lens structure. The lens of FIG. 6 is defined as a posterior surface A, including the base curve, and an opposing anterior surface B, including the power curve, each of which is the composite of, optimally, a plurality of optical and complementary surfaces. For the ease of description, the lens of FIG. 6 has been divided into major regions having an average radius of curvature denoted as $r_i$; however, the ideal lens will very closely parallel the changing rate of curvature of an eyeball for maximum visual acuity and wearer comfort and will, thus, be comprised of literally hundreds of individual surfaces of varying radius. Indeed, the present invention is expressly directed to the generation of such aspheric optical surfaces, as well as the typically spherical power curves, or combination thereof, and wherein the various individual radii including those of the edge, exhibit a tolerance within 0.0004 inches, and preferably within 0.0001 inches. In other words, the posterior surface of the lens is precisely formed for correspondence with the changing rate of curvature of the eyeball by providing a surface comprised of a plurality of discrete optical surfaces with individual posterior radii, each of which is accurate, for correspondence with the eyeball, within a tolerance of 0.0004 inches, preferably of 0.0001 inches. Likewise, the anterior surface is precisely formed for optical resolution (when considered in concert with lens thickness, material, etc.) by similarly providing a surface comprised of discrete optical surfaces with individual anterior radii, each of which is accurate, for optical resolution, within a similar tolerance of 0.0005 inches, preferably of 0.0001 inches. A finished contact lens 200 in accordance with the invention is shown in even greater detail in FIG. 7, and whereat it will be seen that, according to the invention, there is no sharp juncture between the power curve and the lenticular (as is the case with all of the prior art lenses). Similarly as regards the blend, which may be sharp, medium or heavy. Moreover, the base curve need not be spherical, but will match the eyeball, whether spherical, aspheric, etc. The power curve may likewise be curve corrected to eliminate spherical aberration. Concentrics (for "add", or otherwise) too are readily formed into the lens according to the invention with no discernible lines or junctures between zones. Thus, bifocal lenses, trifocals, omni-focals, aspheric lenticulars, aspheric lenticular running parallel to an aspheric base, all heretofore unknown to the art, are quite readily formed consistent with the invention. And so too a lens may be shaped having a changing rate of curve with a graduated power change in a transition zone between "distance" and "add".

The significance of the ability of the apparatus of the present invention to yield lenses of such complicated geometrical shapes, in a fundamentally simple and automated or semi-automated manner and yet with an exacting degree of reproducibility, is manifest when one considers the vagaries of eyeball geometrics. Optimally, an eyeball would be spherical for maximum optical resolution. However, it is found that only the central portion of the eyeball is even approximately spherical, while it tends to flatten as the radius from center increases. Thus, the eyeball is typically seen to be mathematically described by elliptical, parabolic, and hyperbolic functions. Certain visual defects further compound these complicated geometries.

For example, keratoconus-type defects results in an eyeball configuration exemplified as a cone, wherein the apex corresponds to the central corneal region. Currently, contact lenses have been found to be the only effective device for optical correction of this defect and, typically, the patient will be fitted with a series of lenses to promote, or indeed force, a more spherical shape for the eye. However, the ability to accurately and reproducibly form contact lenses for patients suffering keratoconus-type defects has been elusive, at best, and unsatisfactory as a general proposition. This is because each individual lens must first be roughly formed and then individually, hand polished to provide a tolerable fit on the eyeball. In so fitting the lens, any conceivable reproducibility in the initial shaping is lost completely by the subsequent, trial-and-error polishing technique. This severe condition is completely eliminated by the computerized controlled system according to the invention.

Even considering a "normal" eyeball, the inability to precisely form the posterior surface of the lens by use of present machinery results in the need for the doctor fitting that lens to resort to additional lens polishing or modification to adequately fit the lens to the patient. Again, because of the ad hoc nature of this technique, any conceivable reproducibility is similarly lost. Therefore, should the patient lose or damage a lens, it becomes virtually impossible to match a replacement lens.

The automated or semi-automated machine in accordance with the present invention eliminates all of the disadvantages inherent in the current trial-and-error methods employed. Any complex posterior lens geometry may be accurately and reproducibly generated to maximize not only wearer comfort, but insure stable and strictly reproducible correspondence with the eyeball surface. The anterior surface may then be appropriately formed in order to effectively yield a spherical shape, at least in the optical zone, whereby optical resolution is similarly maximized.

The posterior surface A may be said to be comprised of a central base curve, $r_1$, for contact with the corneal portion of the eyeball. Circumferentially peripheral to the base curve is a secondary curve in order that the lens may, for example, transgress or vault the sensitive limbus and rest on the scleral region of the eyeball. The anterior surface B is likewise formed of a central, power curve having a radius $r_3$, circumferentially bounded by a peripheral curve, $r_4$. The lens terminates at an edge having a radius $r_5$ designed to maximize wearer comfort.

With particular reference to FIG. 2, the process of the present invention comprises a series of interrelated, fully automated or semi-automated steps. A suitable hydrophilic polymeric material, preferably that described in U.S. Pat. No. 3,721,657, is first polymerized under anhydrous conditions as illustrated in the patent in the form of a cylindrical rod. Other suitable polymers include those disclosed in U.S. Pat. Nos. 3,503,942, 3,532,679, 3,621,079, 3,639,524, 3,647,736, 3,700,761, 3,767,731, 3,792,028, 3,816,571, 3,926,892, 3,949,021, 3,966,847, 3,957,362, 3,957,740, 3,983,083, 3,699,089 and 3,965,063. The rod or bar is thence subjected to a centerless grinding or compomparable exacting machining operation under conditions of acceptable relative humidity, e.g., typically from 30–40%, to accurately render the circumferential surface circular to within, preferably, a diametral tolerance of about 0.0004 inches, preferably about 0.0001 inches. From the ground rod is thensectioned a lens blank or precursor 34. (For ease of description, the lens during its various stages of manufacture will be identified with this numeral, 34). The sectioning of the lens precursor 34 may be made in any convenient manner, desirably also under conditions of acceptable relative humidity, but most preferably, by an automatically fed precision lathe equipped with a standard parting tool which is itself machined or dressed to yield precise opposing faces of the lens precursor. The lens precursor or button thus defines a substantially cylindrical rod having opposing end faces and a circumferential face. The diameter of the button is reproducibly maintained within a tolerance of ±0.001 inches, preferably of ±0.0002 inches, and most preferably of ±0.0001 inches, while the longitudinal axis (thickness) also is reproducibly maintained within a tolerance of ±0.015 inches, preferably of ±0.010 inches, most preferably of ±0.001 inches. Perpendicularity of both opposing faces relative to the outside diameter is maintained within ±0.0005 inches, preferably within ±0.0004 inches, and most preferably within ±0.0002 inches.

The precision lens precursor 34 is then fed from, for example, a magazine load to the air collet 24 of fluid-bearing spindle/motor 16, most preferably an air-bearing spindle such as those currently marketed by Westwind Air Bearings/Federal-Mogul. Once secured within the spindle, the operator may then precisely align the cutting tool 22 with the exact center of the lens precursor 34, optionally with the aid of optional visual displays 32 and 33. To further assist the operator in so positioning the cutting tool, gradient markings may be provided on the screen of the visual display units, either by way of a transparent overlay or by actually generating an image on the cathode ray tube. Alternatively, the aforesaid precise alignment of the cutting tool with the exact center of the button 34 is accomplished, e.g., by physically measuring the tool position and comparing it to a precalibrated standard in the X, Y and Z axes.

Once the operator has so defined the zero datum point for the cutting tool, the computer 12, having appropriately been programmed, will then accurately index the cutting tool 22 via vis-a-vis the spindle/motor 16 by the control of conjoint movement of each of the fluid-bearing X-Y tables 14 and **14*a*, most preferably air-bearing tables such as those currently marketed by Pneumo Precision, Inc. Thus, in a first cutting operation, with both tables in simultaneous computer controlled movement at varying rates of speed, the outside diameter of the desired lens is cut into the lens precursor 34, as well as a portion of the edge radius. Subsequently, the secondary curve and the base curve of posterior surface A are formed as the tool 22** transgresses inwardly of the lens. Preferably, the posterior surface is cut or formed in a series of passes incorporating both roughing and finishing cuts.

Following the complete formation of posterior surface A, the machined optical surfaces may be polished, if needed. However, due to the enhanced accuracy and precision of the machining operation, an optical surface of from about 0.5 to about 4 microinches, is produced, thus rendering any subsequent polishing step optional.

After the machining of the posterior surface A, the semi-finished lens is removed from the air collet 24 of spindle 16 by any suitable mechanical means. After appropriate quality control checks and inspections, the same is manually delivered to the lens blocking machine 100. The semi-finished lens is delivered to the upper spindle 126 of the machine 100 and is retained within air chuck 128. A preformed, preheated, precision lens block 114 having a mechined surface 115 corresponding to the general average radius of curvature of posterior surface A is automatically loaded in rotatable spindle assembly 104 at a first position corresponding to I of FIG. 4. It is optimal that the positions of the semi-finished lens and the lens block be reversed. The table is then indexed 90° by an air switch to a position corresponding to II of FIG. 4, where at the lens block is registered adjacent dispensing appartus 150. The arm 162 is actuated whereby the dispensing orifice 160 is disposd immediately adjacent the upper surface 115 of lens block 114 and a predetermined quantity of adhesive having the correct temperature and viscosity is deposited thereon. [In the alternative "reversed position" embodiment, the adhesive, e.g., hot pitch, is directly applied to the semi-finished lens 34, which is then rotated for even pitch distribution, and thence the head of the lens block engaged therewith and fixedly adhered thereto.]

The arm 162 is then retracted actuating a switch which causes the upper spindle assembly 126 to be displaced vertically downwardly, asdescribed above, whereby the posterior surface A of semi-finished lens 34 is brought into intimate contact with the adhesively-coated lens block 114. Shaft 110 is then caused to rotate a predetermined number of revolutions, such as from about 5 to about 10, in order to evenly distribute a coating on lens adhesive between the surface 114 and A of semi-finished lens 34. In this way, adhesive will adequately account for any negligible differences between the aspheric contour of surface A of lens 34 and the surface 115 of lens block 114. Following this operation, spindle 126 is held in position. The spindle assembly 104 is thence rotated to position III of FIG. 4 to allow the adhesive to set or, if heated, to cool to a solidification temperature, followed by an indexing to position IV whereat the lens block-semi-finished lens assembly is retrieved. Obviously, as the table is indexed through the positions I–IV other lens block assemblies may be fed thereto for affixing other semi-finished lenses as each position is freed upon completion of a given step. Altenatively, all of the foregoing steps may be performed at but a single position.

The lens block/semi-finished lens assembly is then, after appropriate quality controls, manually transferred to air collet 24 of fluid-bearing spindle/motor 16, and the anterior surface B machined substantially as described above with respect to posterior surface A. That is, the fluid-bearing X-Y tables 14 and 14*a* are positioned by the operator to establish the appropriate reference point between tool 22 and the semi-finished lens 34, followed by the machining of the remainder of the edge radius, the peripheral and/or lenticular curve and the power curve defining the anterior surface B in, preferably, a series of passes incorporating both roughing and finishing cuts. Again, while the apparatus is capable of yielding a surface finish of from about 0.5 to about 4 microinches, the anterior surface may optionally be polished to improve the optical quality of the lens, should it be necessary or desirable for a given application. Following the formation of the lens, the lens block, finished lens assembly is automatically retrieved from air collet 24 and the lens demounted and subjected to typical quality control procedures.

When the lens to be produced is for a contact lens application, the optional polishing is neither required nor desired. The lens, as-machined, exhibits excellent optical surfaces for both compatability with the eyeball surface and optical resolution. As used in the specification and claims, the term "as-machined" connotes a lens which is removed directly from the forming or shaping apparatus and which is not subjected to a secondary or ancillary polishing operation. Such finished lenses produced according to the invention, whether "as-machined" or after having been subjected to any polishing operation, are readied for placement on the human cornea by hydrating the same to a soft, pliable state of equilibrium with normal physiological saline solution. The hydrated lenses are also stored in normal saline solution. Obviously, since the contact lens buttons and the optical elements shaped therefrom consistent with the invention are comprised of synthetic hydrophilic polymers in their anhydrous or non-swollen state, it is desirable to avoid conditions of unacceptable relative humidity throughout each of the processing parameters in order to obviate premature, at least partial hydration.

The computer controller 12 will control all of the automatic functions of not only the microinch surface generator 10, but will also, by insertion of basic prescription data, design total lens geometry, including all of the appropriate optical mathematical parameters necessary for generating the appropriate radii for forming the posterior and anterior surfaces of the lens. In addition, the computer will then compute the precise tool coordinates to achieve the predetermined continuous path for the lens geometry and sequence through the various steps necessary to yield the desired lens configuration. For example, the insertion of the keratometer readings of a patient with keatocomus, plus the desired diameter of the lens, the computer will design an aspheric lens for an optimum fit upon that patient's eye. In the production of the anterior surface of such lens, by the insertion of the desired power and optical zone, the computer will establish the appropriate coordinates for optimum vision correction in the optical zone and design an appropriate lenticular relative to the posterior side of the lens.

In order to position the fluid-bearing X-Y tables 14 and 14*a*, an analog to digital converter or interface may be interposed between the requisite drive means for the table and the computer output.

Optionally, the apparatus according to the invention may be equipped with an X-Y plotter for the following purposes:

(1) For the graphic illustration of the lens being generated by drawing a cross-sectional profile magnified 20 to 100 times to verify the accuracy of the computer input;

(b ') Conversely, utilizing the paragraph (1) illustration, by tracing a drawing magnified an exact number of times the size of a desired lens, the computer will control the lens generator and generate a lens surface which is a duplication of the drawing;

(3) by tracing a casting of the eye, or the eyeball itself, the plotter will draw a profile of the cornea greatly magnified and feed the information into the computer for the production of a lens which will be the optimum fit on said cornea;

(4) Trace from a photograph of the eye;

(5) Trace from a template;

(6) If the eye is topographically mapped, then the computerized plotter could draw a cross-section of the desired lens to fit this eye to all comfort degrees and visual acuity, as well as produce all possible X-Y motions for the generation of the actual contact lens;

(7) Also, if there are any generation errors in processing the lens, the deviations or errors could be entered into the computerized plotter and their actual effects observed during manufacturing to illustrate over or under compensations.

Lastly, by utilizing the combination of the various elements according to the invention, the machining operation is conducted with a minimum of vibration, e.g., no greater than about 10 Hz, and an essentially vibration-free operation of no greater than about 2 to 4 Hz is not uncommon.

While the invention has now been described in terms of certain preferred embodiments, the skilled artisan will appreciate that various changes, substitutions, modifications, and omissions may be made without departing from the spirit thereof. Thus, it will be appreciated that not only are "soft" contact lenses readily shaped according to the invention, but also the "hard" or typically PMMA lenses are likewise readily fabricatd. And, indeed, the subject apparatus and computer controller therefor, are capable of designing virtually an infinite number of lens designs, for example, directly from the K readings of a keratometer. Accordingly, it is intended that the scope of the present invention be limited solely by that of the following claims.

What is claimed is:

1. An apparatus for generating a microinch optical surface on an optical lens precursor to yield a lens for proximate contact with an eyeball, comprising a substantially heavy table bed;

a fluid bearing work support spindle including an air collet for holding a lens precursor;

a first air-bearing slide supported on said table bed and adapted for rectilinear translation along a first horizontal axis that is in a plane parallel to the axis of rotation of said spindle;

a circular tipped cutting tool mounted on said first slide;

a second air-bearing slide supported on said table bed and adapted for rectilinear translation along a second horizontal axis that is in said plane and perpendicular to said first axis, said fluid bearing work support spindle being mounted upon said second slide;

a pair of D.C. torque motors respectively coupled to said first and second slides by means of zero backlash lead screws to provide translational movement of said slides along their respective axes;

a computer control system for generating control signals for said motors to provide predetermined coordinated movement of said cutting tool and said spindle in accordance with the mathematical function describing the geometry of the optical surface to be generated only in a rectangular coordinate system; and electro-optical encoders for monitoring the positions of said first and second slides.

2. The apparatus of claim 1 wherein said table bed isisolated from external vibration.

3. The apparatus of claim 1 wherein said second axis is parallel to the axis of rotation of said spindle, such that an optical lens precursor in said spindle is translated along its axis of rotation.

4. A machine for forming a plurality of optical surfaces, each defined by one or more radii, from an optical lens precursor to yield a lens adapted for proximate contact with an eyeball, comprising:

a rotatable air-bearing spindle having a lens precursor holder;

a first air-bearing slide mounted for rectilinear translation along a first axis;

a cutting tool supported on said first slide;

a second air-bearing slide supporting said spindle and mounted for rectilinear translation along a second axis orthogonal to said first axis, said first and second axes being located in a plane that is parallel to the rotational axis of said spindle; and control means for automatically indexing said first and second slides along their respective axes to bring said cutting tool into proximate contact with an optical lens precursor in said spindle and thereafter providing predetermined coordinated translation of said first and second slides only along their respective axes while the optical lens precursor is being rotated in said spindle, which translation along said two axes produces relative movement between said cutting tool and the lens precursor along a prescribed path while they are in engagement to generate the optical surfaces.

5. The machine of claim 4 wherein a plurality of cutting tools are supported on said first slide.

6. The machine of claim 5 further including means for translating each of said cutting tools along a third axis orthogonal to said first and second axes.

7. The machine of claim 4 wherein said indexing and moving means includes computer control.

8. The machine of claim 4 wherein said second axis is parallel to the axis of rotation of said spindle, such that an optical lens precursor in said spindle is translated along its axis of rotation.

9. The machine of claim 4, wherein said lens precursor holder is an air collet.

10. The machine of claim 4, said microsurface generator adapted to operate at no greater than 10 Hz inherent vibration.

11. The machine of claim 4, said microsurface generator adapted to operate at no greater than 4 Hz inherent vibration.

12. The machine of claim 4, said first slide supporting a precision diamond-tipped cutting tool having a circular cutting surface within a tolerance of 0.005 inches truth of circular profile.

13. The machine of claim 4, said automatic indexing being achieved by encoders with no greater than 0.5 micron resolution.

14. The machine of claim 4, further comprising means for controlling the radial and axial runot of the rotating spindle at no greater than 0.000010 inches T.I.R.

15. The machine of claim 4, further including video display means to permit viewing of an enlarged picture of the tool relative to the lens precursor.

16. The machine of claim 4, further including an X-Y plotter.

* * * * *

UNITED STATES PATENT AND TRADEMARK OFFICE

CERTIFICATE OF CORRECTION

PATENT NO. : 4,434,581

DATED : March 6, 1984

INVENTOR(S) : Robert G. Sprigqs

It is certified that error appears in the above-identified patent and that said Letters Patent is hereby corrected as shown below:

Column 1, Line 43 delete "MMA" and insert --PMMA--;

Column 1, Line 53 delete "designated" and insert --designed--;

Column 2, Line 64

Delete "had" and insert --hard--;

Column 3, Line 13 delete "chaacteristics" and insert --characteristics--;

Column 3, Lines 34 and 35 delete "cuttin- gor" and insert --cutting or--:

Column 6, Line 58 after circular profile, insert --preferably within 0.0002 inches truth of circular profile,--;

UNITED STATES PATENT AND TRADEMARK OFFICE

CERTIFICATE OF CORRECTION

PATENT NO. : 4,434,581

DATED : March 6, 1984

INVENTOR(S) : Robert G. Spriggs

It is certified that error appears in the above-identified patent and that said Letters Patent is hereby corrected as shown below:

Column 7, Line 49 delete "NOOP" and insert --ZOOP--;

Column 8, Line 50 delete "28" and insert --128--.

Signed and Sealed this

*Fifteenth* Day of *January 1985*

[SEAL]

*Attest:*

*Attesting Officer*

GERALD J. MOSSINGHOFF

*Commissioner of Patents and Trademarks*